United States Patent [19]

Oubridge et al.

[11] Patent Number: 4,462,868

[45] Date of Patent: Jul. 31, 1984

[54] PAPER WEB DRYING APPARATUS HAVING A HOOD WITH TWO SECTIONS

[75] Inventors: Terence J. Oubridge, Wylam; Ben Boorman, Hexham, both of England

[73] Assignee: Kimberly-Clark Limited, Kent, England

[21] Appl. No.: 371,779

[22] Filed: Apr. 26, 1982

[30] Foreign Application Priority Data

Apr. 27, 1981 [GB] United Kingdom ..... 8112967

[51] Int. Cl.[3] ..... D21C 5/02; D21C 5/18

[52] U.S. Cl. ..... 162/280; 162/290; 34/114; 34/115

[58] Field of Search ..... 162/290, 280, 297; 34/23, 115, 114

[56] References Cited

U.S. PATENT DOCUMENTS

| | | | |
|---|---|---|---|
| 3,416,237 | 12/1968 | Sutherland | 34/23 |
| 3,576,078 | 4/1971 | Holt | 34/23 |
| 3,797,126 | 3/1974 | Parkes | 34/114 |
| 3,891,500 | 6/1975 | Kankaanpaa | 162/290 |

*Primary Examiner*—Steve Alvo

*Attorney, Agent, or Firm*—Fidelman, Wolffe & Waldron

[57] ABSTRACT

A paper web drying apparatus having a throughdrying drum wherein heated air is supplied beneath a hood around a portion of the periphery of the drum through which the air may pass, the hollow interior of the drum being connected to exhaust means, the hood distributing heated air to the surface of the web, the improvement according to the invention comprises dividing the hood into at least two separate sections, the section adjacent the web inlet having a series of nozzles connected to a source of heated air and interspersed air ducts or the like connected to air exhaust means, the section adjacent the web outlet being connected to a source of heated air but not to exhaust means. This enables impingement drying to take place adjacent the web inlet, impingement and throughdrying to take place at a point further along the arc of travel of the web beneath the web and only throughdrying to take place during the final portion of the web travel.

9 Claims, 4 Drawing Figures

PAPER WEB DRYING APPARATUS HAVING A HOOD WITH TWO SECTIONS

Figure 1:
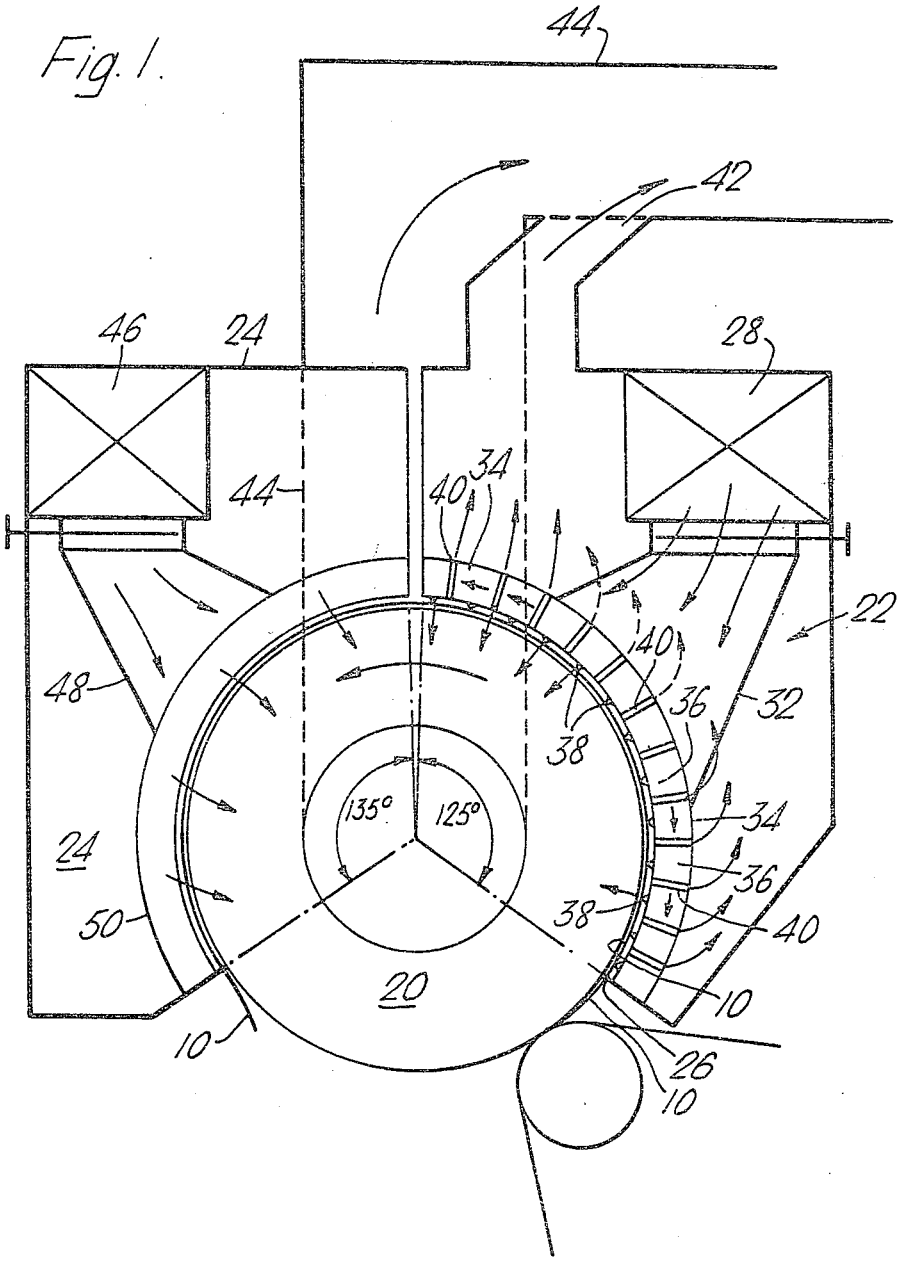

This invention relates to the drying of wet webs of paper and the like.

In recent years, apparatus for the rapid drying of a paper web has been proposed in which a relatively large volume of heated air is passed through the web whilst the web is passing over the periphery of a pervious, honeycomb or the like, hollow rotating drum. Such a drying system is known as "throughdrying".

Clearly, the heated air may either be passed through the web, normally whilst the web is supported on a wire or other paper making fabric, from a chamber surrounding, or partially surrounding, the drum into the interior of the drum or vice versa. The heated air dries the web both by physically drawing drops of water from the web as the air passes through the web and by vapourising the water in the web into steam which is then drawn from the web. The heated air may either be blown through the web under pressure, sucked through the web by use of a vacuum or a combination of the two.

Throughdrying of webs such as paper webs is being adopted on an increasing scale as such a system achieves faster drying than other known drying devices whilst maintaining the web in a relatively soft uncompacted condition to maintain a soft feel or "hand". However, during the first drying stage it has been found that the moisture carried by the web prohibits or restricts the rapid passage through the web of a large volume of heated air. This has been found to limit the speed of the web, if it is satisfactorily to be dried, and hence the output speed of a paper making machine or the like of which the throughdrying device forms a part.

This problem is solved or alleviated by "throughdrying" apparatus in accordance with the invention wherein the heated air is supplied beneath a hood or the like surrounding a portion of the periphery of a hollow, rotatably mounted drum having a surface through which air may pass, the hollow interior of the drum being connected to a pump or the like to create a reduced pressure within the drum to draw air from the outside to the inside of the drum through a web supported on the drum characterised in that the hood, air header or the like is divided into at least two separate sections, the section adjacent the web inlet having a series of nozzles or other apertures connected to a source of pressurised heated air and interspersed with a series of air ducts, tubes or the like connected to air exhaust means, the section adjacent the web outlet being connected to a source of heated air, but not to exhaust means, so that heated air which is blown through the nozzles/apertures against the relatively impervious wet web adjacent the inlet, (which air does not readily pass through the web), may be exhausted from above the web and the heated air supplied to the hood section adjacent the outlet is all drawn through the web.

In this way, a very efficient web drying system is produced. The hot air which impinges against the relatively wet web at the inlet to the throughdrying apparatus and which does not easily pass through the web acts to heat the web and produces an initial drying as it carries steam and moisture away from the web as it is exhausted from above the web. As the web dries and becomes more porous as it passes around the rotating roll beneath the first hood section, progressively more of the air passes through the web to be exhausted from within the throughdrying drum so that at each point during passage of the web beneath the first hood section, the balance between heated air passing through the web and heated air which in effect only impinges on the surface of the web and is exhausted from above the web, is self regulating.

At the point between the two hood sections, the web is sufficiently dried and hence sufficiently porous for there to be so little restriction on heated air passing through the web that virtually all the air constitutes "throughdrying" air, which produces the most efficient drying of the web.

As an example, it has been found that a hood having a first section which extends about 125° around the periphery of the drum is very satisfactory. During this passage through this section, with a web having a basis weight of about 40 gsm, about 67% of the air passes through the web with 33% being exhausted from above the web. The second hood section may extend for about 135°.

The throughdrying apparatus may dry a wet web of paper from about 25% fibre, the remainder being water, to about 90% fibre.

It will be appreciated that if all the air passes through the web on its passage around the throughdrying drum as opposed to apparatus in accordance with the invention in which, at the inlet section, some of the air does not pass through the web, it is very difficult to get even drying which leads to an unevenly dried sheet. Clearly, the air will tend to pass through the web at those places where there are no drops of moisture held by the web and this accentuates the uneveness. With the removal of moisture laden air from the surface of the web, the moisture problems are alleviated and this has been found significantly to help to achieve even drying across the sheet. Also the wet web is not driven at the inlet against the wire, which causes "stapling", to the same extent and again this reduces the "stapling" problem.

Preferably, the throughdrying drum has a honeycomb periphery and the air in the first section is supplied through nozzles extending across the width of the drum and which are separated in the peripheral direction, by "return" air tubes.

The wet air and steam may be exhausted from within the throughdrying drum in an axial direction.

Whilst a two section hood is preferred, a three section hood may be provided so that in the section adjacent the inlet all the air is exhausted from above the web, in the second or central section some air is exhausted from above the web and some from within the drum and in the third section all the air is exhausted from within the drum.

Figure 2:
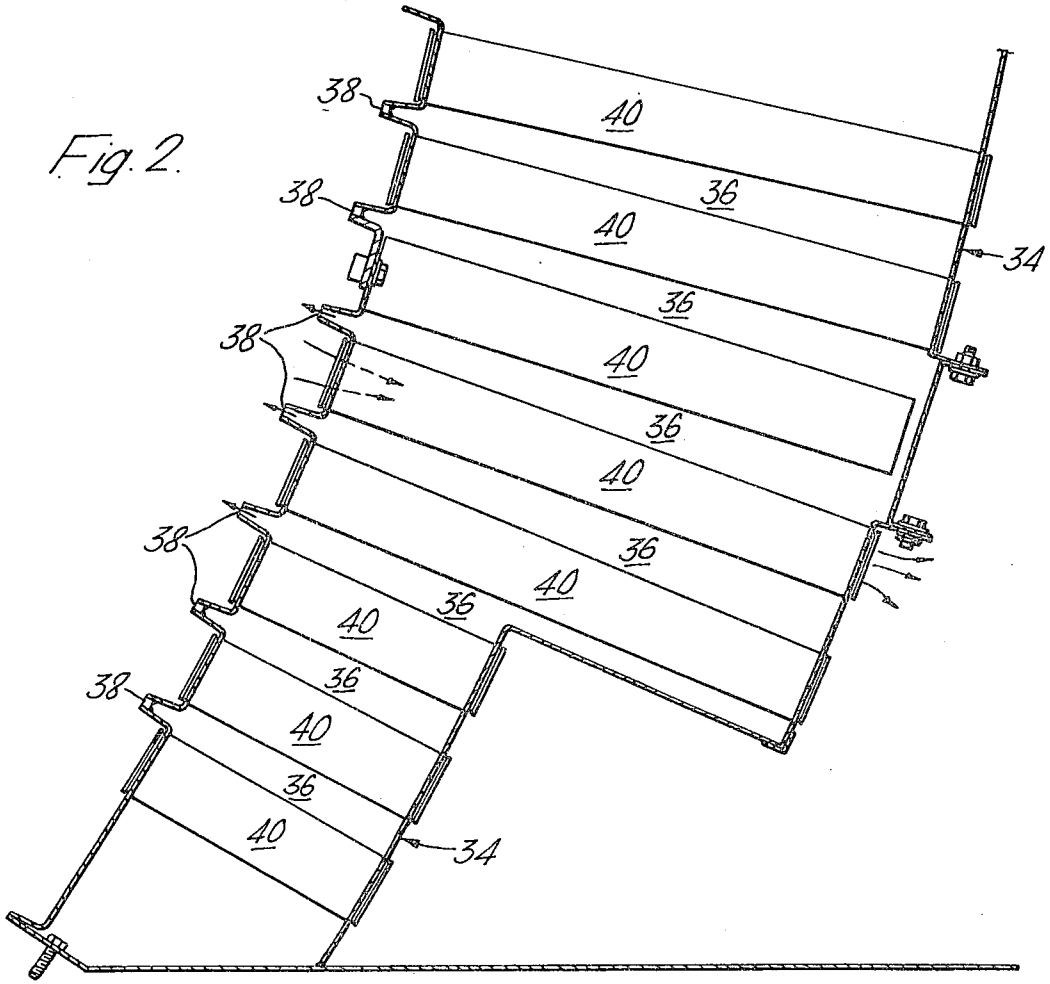
Figure 3:
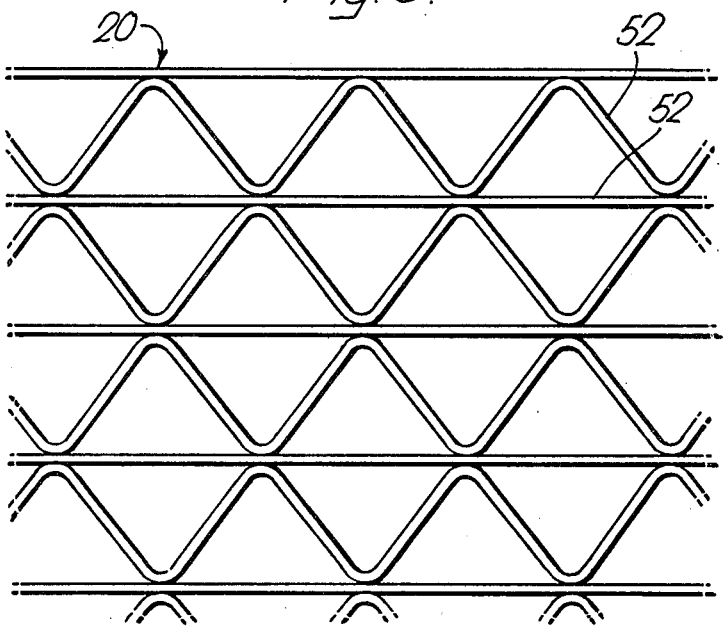
Figure 4:
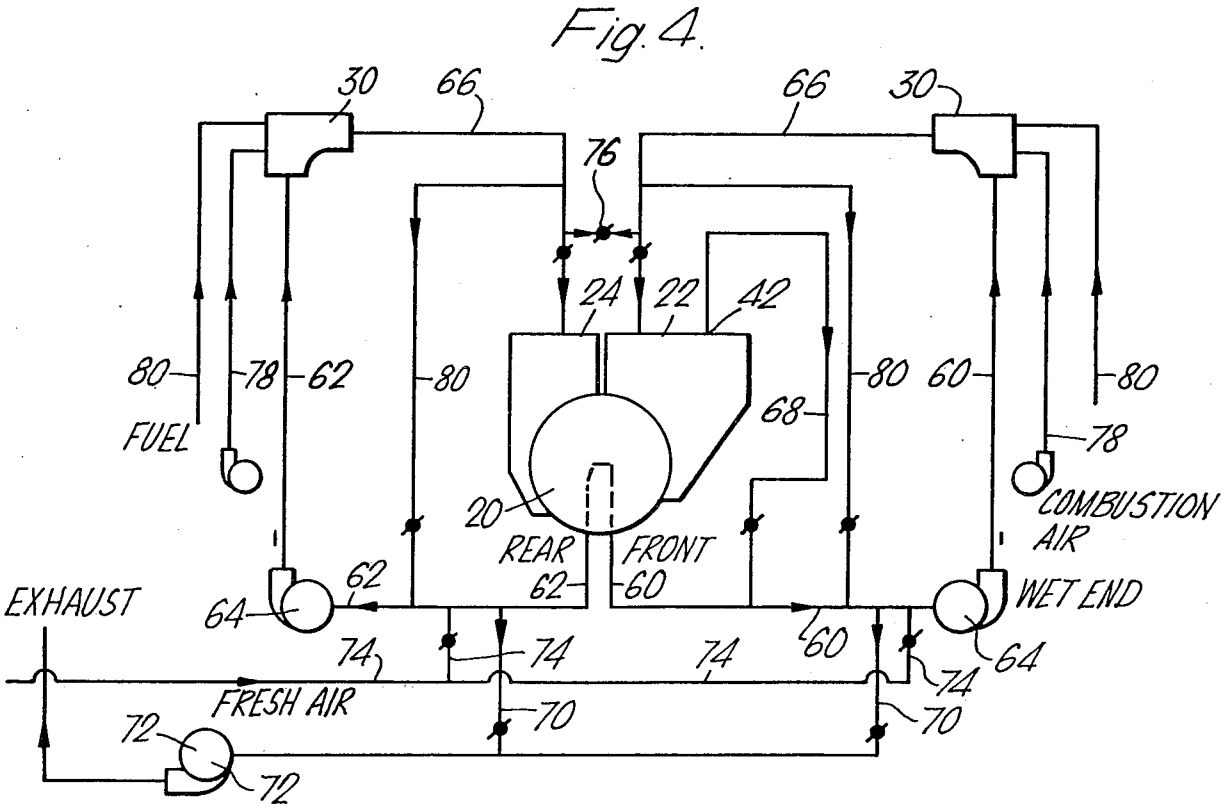

The invention will now be further described by way of example with reference to the accompanying drawings, in which:

FIG. 1 is a sketch, partially in cross-section of one embodiment of throughdrying apparatus in accordance with the invention for incorporation in a paper making machine, FIG. 2 is a sketch, on an enlarged scale, showing the nozzles and return air ducts of the first hood section of the apparatus shown in FIG. 1, FIG. 3 is a detail view to an enlarged scale, of part of the surface of a drum for use in the apparatus of FIG. 1, and FIG. 4 is a diagram illustrating the inlet and exhaust connections of the heated air to the throughdrying apparatus of FIG. 1.

In the paper making machine in which the hood of FIG. 1 is incorporated, a paper web is carried by a wire around rolls and is subjected to steam showers and vacuum boxes for preliminary drying.

The web is then transferred to the outer side of a wire or fabric 10, so that the web is carried around the periphery of a throughdrying drum 20 (see FIG. 1) on the outside of the wire.

After being dried by the throughdrying apparatus, the web is carried on, or between, further wires around rolls to the periphery of a heated Yankee cylinder, the web being stuck by adhesive to the periphery of the cylinder. The web is then carried around the periphery of the cylinder where further heating and drying occurs and is creped from the periphery of the cylinder by a standard creping blade. The web is then fed to a standard reeling unit.

As can be seen in FIG. 1, the throughdrying drum 20 which has a honeycomb periphery (see FIG. 3) is rotated in an anti-clockwise direction as seen in the drawing. The drum is hollow and air, steam or the like may be exhausted axially from the drum.

The drum is surrounded by a hood formed into two separate sections 22, 24, the section 22 being that adjacent the inlet 26 through which the paper web passes to be fed around the periphery of the drum, and the section 24 being adjacent the web outlet from the drum.

The hood section 22 has an air supply chamber 28 connected to an air heater 30 (see FIG. 4), the air then being fed through ducting 32 to an air distribution header 34 surrounding the periphery of the drum. Valves are provided in practice to adjust air flow across the width of the hood. As can be seen in FIG. 2, the air, after entering the header 34, passes through air feed pipes or ducts 36 each of which terminates at a nozzle 38 (extending across the width of the drum 20) and positioned closely adjacent to the periphery of the drum 20.

Thus hot air being supplied to the header 34 blasts out through the nozzles 38 to impinge against the outer surface of a wet web of paper being fed around the periphery of the drum on the wire 10 adjacent the nozzles.

At a position closely adjacent the inlet 26 the web is at its wettest and least pervious so that very little, if any, heated air passes through the web. Rather, the air impinges on the surface of the web which is rapidly heated by the air and the heated air carrying moisture from the web is removed from the web surface through a bank of return air tubes 40 one being positioned between each air supply duct 36. These return air tubes are open through the header 34 into the interior of the hood 22 from which the air is exhausted by an exhaust fan through an outlet generally indicated at 42.

As the drum 20 rotates and the web passes further around beneath the header 34 it becomes dryer and hence more porous, to allow part of the heated air to pass through the web into the interior or the drum 20 from whence it is extracted under reduced pressure through a main return duct 44.

By the time that the drum has rotated through about 125° the web is sufficiently dry and hence porous for all of the heated air to pass relatively easily through the web and at this point the drum passes beneath the second hood section 24.

The second hood section 24 contains a heated air supply chamber 46 connected through a duct 48, with an air distribution header 50. However, the header 50 does not contain a bank of nozzles and return air tubes but is merely open to the surface of the web through a perforated plate designed to distribute the air evenly around the drum periphery so that all the hot air within the header 50 passes through the web and then through the periphery of the drum 20 to be exhausted axially from the drum through return duct 44. However the header does have numerous valves to adjust the air flow across the width of the hood.

The web, after leaving the first section and before passing beneath the second hood section 24 is about 50% dry. The second section of the hood extends about 135° around the periphery of the drum and when the web leaves this section it is about 90% dry.

As can be seen from FIG. 3, the surface of the drum 20 over which the wire or fabric 10 passes, is of honeycomb construction constituted by members 52 allowing air readily to pass through for exhaustion from the centre of the drum, whilst providing a rigid support for the fabric and web.

Referring to FIG. 4, it can be seen that air is exhausted from each end of the drum 20 through exhaust pipes 60, 62 and passes through supply pumps 64 before being returned through pipe 66, to the air heaters 30 (one for the wet end and one for the dry end) and the re-heated air is then passed back to the air supply chambers 28 and 46 in the hood section 22 and 24 respectively.

Wet air from the outlet 42 of the first hood section 22 is returned through a pipeline 68 to join with the pipeline 60 upstream of the pump 64.

Some of the wet air is exhausted from the pipelines 60, 62 through exhaust lines 70 in which an exhaust pump 72 is connected, and at the same time sufficient make-up fresh air is introduced through pipelines 74 which connect with pipelines 60, 62 downstream of the exhaust lines 70 but upstream of the exhaust pumps 64.

The relative flows of combusion air, exhaust and supply air, may be controlled by variable valves or dampers to produce the most efficient supply and exhaust of air.

A crossover valve 76 connects the hot air input pipes 66 from the two heaters 30. This valve is normally closed but may be opened in an emergency. Hot air may be recirculated through lines 80 if required. Combustion air and fuel is fed to the burners 30 through pipe lines 78, 80 respectively.

As an example, with a throughdrying drum having a 16 ft (4.877 meters) diameter, the speed of the web around the drum may vary from 2,500 feet (762 meters) per minute up to 5,000 feet (1524 meters) per minute depending upon the basis weight of the sheet. The supply of air at the wet/inlet end and at the dry/outlet end is about 255,000 cubic feet (7079 cubic meters) per minute each at a temperature of about 400° F. (204.4° C.) although this temperature may be increased up to about 700° F. (371.1° C.). The air pressure in the inlet or wet end section of the hood is about 2.1 inches (53.34 mm) of water gauge at 600° F. (315.6° C.) and the pressure in the outlet or dry end section of the hood is about 0.0525 inches (1.344 mm) water gauge at 600° F. (315.6° C.). The negative air pressure within the throughdrying drum is 20 to 25 inches (508 to 635 mm) water gauge.

The air velocity through the nozzles at the inlet end is about 10,000 feet (3048 meters), the air velocity at the outlet end being about 5,000 feet (1524 meters) per minute.

In some cases, it may be desirable to have a damping steam shower within the hood.

We claim:

1. Paper web drying apparatus comprising:

a hollow, rotatably mounted drum having a web supporting surface through which air may pass;

a hood surrounding said drum between a web inlet and web outlet, said hood extending for more than 180° around said drum;

means to divide said hood into at least two sections, said sections fixed one relative to another, said first hood section adjacent the web inlet having a plurality of nozzles connected to a source of pressurized heated air and having interspersed among said apertures a plurality of ducts in the peripheral direction communicating between the surface of said web and exhaust means, the last of said hood sections adjacent the web outlet and connected to said source of pressurized heated air but having no communication with said exhaust means, said pressurized heated air in the last of said hood sections passing through a perforated plate to said web, and evacuating means connected to the interior of said hollow drum, said evacuating means adapted to withdraw wet air and stem from said drum interior and to maintain a reduced pressure therein.

2. Paper web drying apparatus as claimed in claim 1 wherein said first hood section extends for about 125° around the periphery of the drum.

3. Paper web drying apparatus as claimed in either claim 1 or claim 2 wherein said last hood section extends for about 135° around the periphery of the drum.

4. Paper web drying apparatus as claimed in claim 1 wherein the wet air and steam is exhausted from within the drum in an axial direction.

5. Paper web drying apparatus as claimed in either claim 1 or claim 2 wherein the heated air in said first hood section is caused to impinge against a wet web on the drum surface through said nozzles extending across the width of the drum.

6. Paper web drying apparatus as claimed in claim 1 wherein the drum has a honeycomb periphery.

7. Paper web drying apparatus as claimed in claim 1 including means for removing from the apparatus a portion of the wet air and steam evacuated from the drum interior; ducting means for circulating the remainder of said evacuated wet air and steam to said first and last hood sections; and means for introducing make-up fresh air into said hood sections.

8. Paper web drying apparatus as claimed in claim 7 including ducting means communicating between the duct exhaust means of said first hood section and those ducting means circulating wet air and steam to said first and last hood sections.

9. A paper making machine comprising means for the preliminary drying of a paper web, web conveying wire means carrying said web to a main drying apparatus, said apparatus comprising the paper web drying apparatus of claim 1, said apparatus comprising means for drying the web to about 90% dry, said machine further comprising a creping drum and reeling unit positioned downstream of said main drying apparatus.

* * * * *